US005666592A

United States Patent [19]

Aslam et al.

[11] Patent Number: 5,666,592

[45] Date of Patent: Sep. 9, 1997

[54] VARIABLE GLOSS FUSER

[75] Inventors: Muhammad Aslam, Rochester; Robert D. Bobo, Ontario, both of N.Y.

[73] Assignee: Eastman Kodak Company, Rochester, N.Y.

[21] Appl. No.: 631,335

[22] Filed: Apr. 12, 1996

[51] Int. Cl.[6] ..... G03G 15/20

[52] U.S. Cl. ..... 399/67; 219/216; 399/329

[58] Field of Search ..... 355/285, 290; 219/216; 432/59, 60

[56] References Cited

U.S. PATENT DOCUMENTS

| | | | |
|---|---|---|---|
| 4,639,405 | 1/1987 | Franke | 430/124 |
| 4,791,447 | 12/1988 | Jacobs | 355/290 |
| 4,973,824 | 11/1990 | Ohashi et al. | 219/216 |
| 5,019,869 | 5/1991 | Patton | 355/290 |
| 5,023,038 | 6/1991 | Aslam et al. | 264/293 |
| 5,089,363 | 2/1992 | Rimai et al. | 430/45 |
| 5,296,904 | 3/1994 | Jackson | 355/290 |
| 5,436,711 | 7/1995 | Hauser | 355/290 |

*Primary Examiner*—Arthur T. Grimley
*Assistant Examiner*—Sophia S. Chen
*Attorney, Agent, or Firm*—Leonard W. Treash

[57] ABSTRACT

A fuser includes both a fusing roller and a fusing belt, each separately engageable with a pressure member forming first and second nips for applying a finish to a toner image. The first nip between the fuser roller and the pressure member can provide a matte or textured finish to a print while the second nip between the belt and the pressure member provides a high gloss finish. The fusing roller engages the pressure member through an opening in the belt when the belt is stopped with the opening properly positioned. The fuser roller backs the belt when the belt is being used for fusing or finishing.

16 Claims, 2 Drawing Sheets

VARIABLE GLOSS FUSER

This invention relates to the fusing of toner images to a receiving sheet. More specifically, it relates to a fuser that can provide more than one type of finish to a toner image.

Substantial prior art is directed to the challenge of designing a toner image fuser that can provide a variety of finishes. For example, U.S. Pat. No. 5,019,869 to Patton, issued May 28, 1982, shows the use of three different rollers having glossy, matte and textured surfaces, respectively, which can be selectively brought into a position forming a nip with a pressure roller. The choice of the roller determines the finish imparted to the image.

U.S. Pat. No. 4,791,447 to Jacobs, issued Dec. 13, 1988, shows a color fuser with three rollers forming two nips. Matte images are provided by feeding a sheet through one nip, while glossy images are provided by deflecting the sheet after it passes through the first nip into the second nip. For a similar approach, see also U.S. Pat. No. 5,296,904 to Jackson, issued Mar. 22, 1994.

U.S. Pat. No. 5,089,363 to Rimai et al, issued Feb. 18, 1992, and U.S. Pat. No. 5,023,038 to Aslam et al, issued Jun. 11, 1991, show belt fusers in which a toner image is kept in contact with a heated belt and separated only after it has cooled sufficiently to be separated without offset. In at least one embodiment, the belt has both a hard, smooth surface and a textured surface. Selection between the surfaces can be made by controlling the timing of the sheet with respect to the belt surface. These two patents are incorporated by reference herein.

U.S. Pat. No. 4,639,405 to Franke, issued Jan. 27, 1987, shows a finishing device that includes a pair of fusing rollers and a pair of finishing rollers. The pair of fusing rollers essentially fix the image while the finishing rollers provide the desired gloss in an extra treatment.

The belt approach, as shown in several of the above references, provides the highest gloss presently obtainable for color toner images. The gloss can be made especially high with an extremely hard metallic surface which essentially ferrotypes the image, removing visible contours common in color toner images from variations in toner stack heights.

SUMMARY OF THE INVENTION

It is an object of the invention to provide an improved fuser/finisher which can apply different surface treatments to a toner image carried by a receiving sheet.

This and other objects are accomplished by a fuser which includes a pressure member, for example, a pressure roller. A fusing roller is positionable to form a first fusing nip with the pressure member. A fusing belt is positionable to form a second fusing nip with the pressure member, the second fusing nip providing a different gloss or surface treatment to a fused toner image than the first fusing nip. One of the first and second fusing nips is applied to the receiving sheet to fuse or finish the toner image.

According to a preferred embodiment, the fusing belt is a hard metallic belt which applies a high gloss while the fusing roller can be an ordinary elastomeric fusing roller which applies some texture to the image or can be a purposely textured surface to apply a more roughened texture, if desired.

According to another preferred embodiment, the belt is driven through an endless path, a portion of the path extending around the fusing roller. The belt may or may not be supported by the fusing roller. The belt has an opening through which the fusing roller can directly contact the pressure roller with the belt stopped when the first nip is being used. With the belt moving, fusing or finishing is accomplished by direct contact between the belt and the image with the belt being backed by the fusing roller. This embodiment can be implemented by driving the belt with a clutched pin and sprocket drive connected to a drive gear mounted on the same shaft but movable relative to the fusing roller.

The preferred embodiments provide a choice of finishes with a relatively productive roller fuser for normal, matte or textured finishes and a high quality belt fuser for very high gloss color images.

DETAILED DESCRIPTION OF THE INVENTION

The invention can be used to do the entire fusing of a toner image to a receiving sheet or it can be used to finish an image after it has been partially or completely fused upstream. In both instances, the functions are similar. A receiving sheet having a toner image is treated with a combination of heat and pressure to provide the desired effect on the toner image. Although the invention can be used with ordinary black and white toner images, such as those made from a conventional office copier, it is especially designed and most useful with high quality color images whose finish is more critical.

Figure 1:
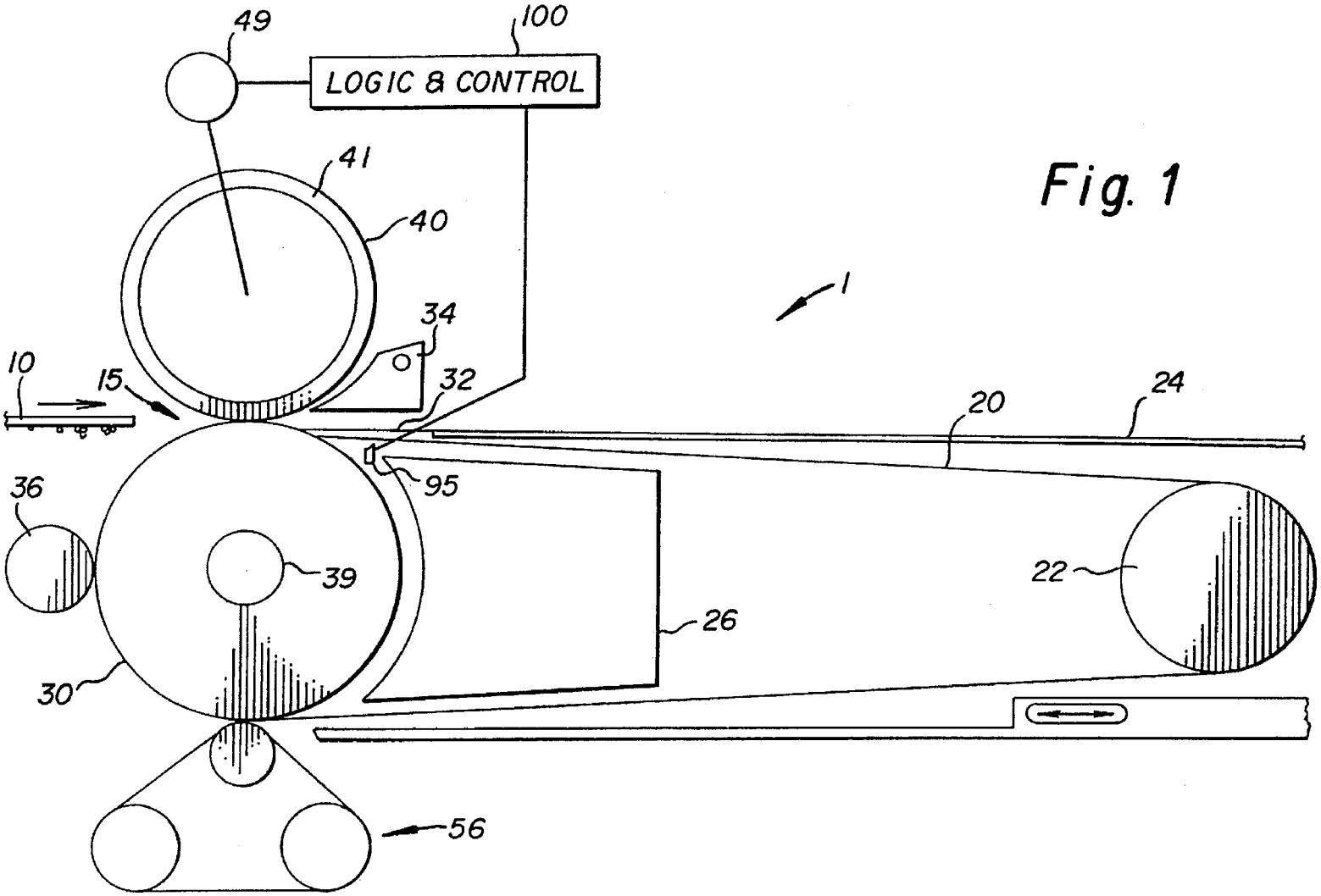
FIGS. 1 and 2 are side and perspective schematics of a fuser/finisher.

Referring to FIG. 1, a receiving sheet 10 having a toner image on its lower image bearing side is fed into a nip area 15 for treatment by a fuser or finisher 1 (hereinafter usually called a fuser). Fuser 1 includes a pressure member, for example, a pressure roller 40, for contacting the backside opposite the image side of receiving sheet 10. A fusing roller 30 is positioned to engage pressure roller 40 and form a first fusing nip. Fusing roller 30 is internally heated by a lamp 39. An offset preventing liquid is applied to the surface of fusing roller 30 by a suitable toner applying wick or roller 36 to prevent offset of the image onto the surface of the fusing roller 30. A web cleaner 56 is positioned to continuously clean fusing roller 30 and can also be used to apply an offset preventing liquid to it, as an alternative to wick or roller 36.

Fusing roller 30 can have a typical fusing roller surface of polytetrafluoroethylene or an elastomeric material such as silicone rubber. This surface provides a known finish to the toner image, depending on the material used, which can have a medium gloss, in the case of tetrafluoroethylene, or a more matte finish, in the case of silicone rubber. To provide the much higher gloss levels desired for high quality color images, a much harder surface is necessary. It is also quite desirable to eliminate the use of silicone oil for highest quality images. It is known from prior art cited above that a hard belt, preferably metallic, can provide gloss levels substantially higher than a polytetrafluoroethylene covered roller. Further, if the image is allowed to cool in contact with the belt before separation, use of silicone oil can be reduced or avoided altogether.

Figure 2:
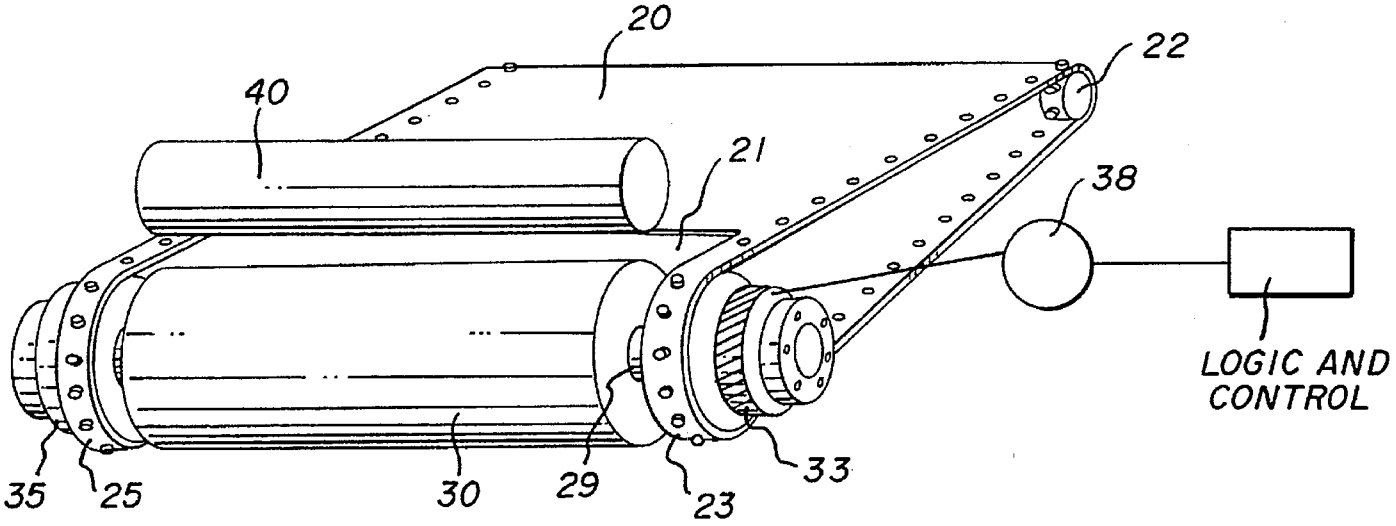
Figure 3:
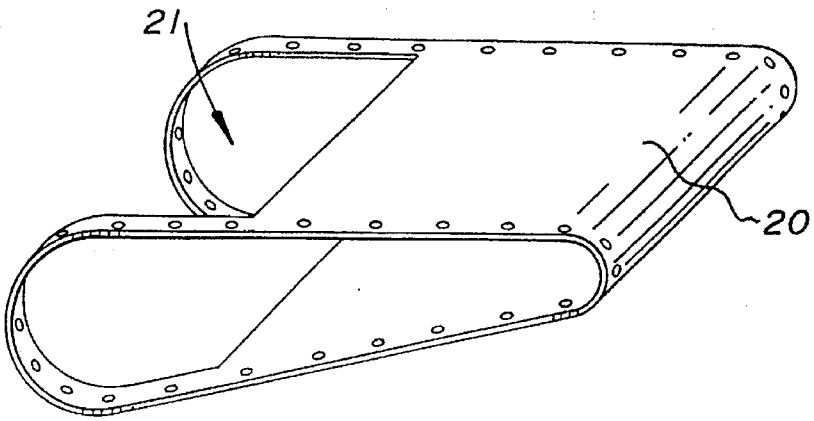
FIG. 3 is a perspective of a fusing belt.

Accordingly, fuser 1 is convertible to a belt fuser. As best seen in FIG. 2, a hard metallic belt 20 has an opening 21 through which the fusing roller 30 and pressure roller 40 can contact each other, forming the first fusing nip in nip area 15. Belt 20 is mounted between a steering roller 22 and belt drive rollers 23 and 25. Belt sprocketed drive rollers 23 and 25 are driven through drive gears 33 and 35 by a suitable drive means 38 controlled by a logic and control 100 and drive the belt through a sprocket and perforation drive, as shown in FIG. 2. Fusing roller 30, drive rollers 23 and 25 and drive gears 33 and 35 are coaxial and all journaled on a shaft 29 with fusing roller 30 drivable independently of rollers 23 and 25.

In operation as an ordinary roller/fuser, as described above, belt 20 is stopped in response to the sensing of a leading edge of opening 21 by a suitable sensor 95 (FIG. 1), with opening 21 in the position shown in FIG. 2. Fusing roller 30 is frictionally driven by pressure roller 40 which is driven through its own drive 49, as controlled by is logic and control 100.

When highest gloss is desired, belt 20 is driven through rollers 23 and 25, as controlled by sensor 95 and logic and control 100, and forms with pressure roller 40 a second fusing nip. In this mode, pressure roller 40 could continue to be driven at the same speed as the belt, however, it is preferable that the drive be disengaged and pressure roller 40 and fusing roller 30 both be driven by frictional engagement with belt 20. Similarly, wick 36 is articulated away from fusing roller 30, and fuser 1 operates as a heated belt fuser.

Receiving sheet 10 now comes into a second nip formed between belt 20 and pressure roller 40 in nip area 15. Fusing roller 30 and drive rollers 23 and 25 should be approximately the same circumference, so that fusing roller 30 backs belt 20 in the second nip. This is preferably a higher pressure nip than the first nip. Although this will necessarily be the case with the extra element in the nip (the belt 20), it may be desirable to increase the load between pressure roller 40 and fusing roller 30 when in this second or belt mode.

The receiving sheet stays in contact with the belt until it reaches steering roller 22. As the belt goes around the relatively small steering roller 22, the receiving sheet separates. In the space between steering roller 22 and the second nip between the belt and pressure roller 40, the image cools sufficiently to separate from belt 20 without offset to it. This cooling can be aided by positioning a cooler 26 immediately after the second nip. Cooler 26 can be a suitable heat transfer device which withdraws heat from belt 20 just after the nip area 15 and adds it back into the belt just before the belt contacts the heated fusing roller 30 again.

Preferably, cleaner 56 stays in engagement and cleans belt 20 in this mode in the same way it also cleaned fusing roller 30. A light amount of offset preventing liquid could be added by cleaner 50 to the belt if desired. Preferably, no offset preventing liquid is used for highest quality images.

In the first mode of operation, separation of the receiving sheet 10 from rollers 30 and 40 is accomplished by an upper skive 34 which is permanently urged against the surface of pressure roller 40 and a lower skive 32. Lower skive 32 is attached to a cover 24 for belt 20, which cover is movable from right to left, as shown in FIG. 1, when fuser 1 is adjusted to its first mode of operation as a roller/fuser. Cover 24 is moved sufficiently to the right when fuser 1 is moved to its second mode of operation as a belt fuser that skive 32 and cover 24 are out of the way of a receiving sheet on the belt surface. As shown in FIG. 1, pressure roller 40 has a compliant layer 41 which is chosen to provide some nip length with a hard fusing roller or fusing belt. Alternatively, pressure roller 40 can be hard and fusing roller 30 somewhat compliant which also provides some length of nip.

Many alterative structures can be provided for driving the belt independently of fusing roller 30. The one shown is but a single example and others are well within the skill of the art. For example, belt 20 could be driven by steering roller 22 and the sprocket and perforation drive eliminated. As always with a belt fuser, suitable tension and tracking mechanism should be provided, which also is within the skill of the art.

The invention has been described in detail with particular reference to a preferred embodiment thereof, but it will be understood that variations and modifications can be effected within the spirit and scope of the invention as described hereinabove and as defined in the appended claims.

I claim:

1. A fuser for selectively providing different types of finishes to toner images carried on image sides of receiving sheets, said fuser comprising:

a pressure member;

a fusing roller positionable to form a first fusing nip with the pressure member;

a fusing belt positionable to form a second fusing nip with the pressure member, said second fusing nip providing a different type of finish to a fused toner image than that provided by the first fusing nip, wherein said belt is entrained about at least two support members for movement through an endless path, at least one of the support members being coaxial with said fusing roller and wherein said belt has an opening through which the fusing roller is accessible to the pressure member when said belt is at a predetermined position in its endless path; and a controller selectively applying one of said first and second fusing nips to a receiving sheet to fuse or finish the toner image.

2. The fuser according to claim 1 wherein the belt has a hard surface for applying a higher gloss to the image than the fusing roller.

3. The fuser according to claim 2 wherein said belt has a metallic surface.

4. The fuser according to claim 1 wherein the pressure member is a pressure roller.

5. The fuser according to claim 1 further including means for heating a receiving sheet in each of the first and second nips and means for separating a receiving sheet from the fusing belt after a fused toner image has cooled in contact with the belt.

6. The fuser according to claim 1 wherein said pressure member is a pressure roller.

7. The fuser according to claim 6 wherein the fusing roller is drivable independently of the fusing belt through an endless path with the fusing roller backing the endless belt during a portion of the endless path during which the second fusing nip is being applied to a receiving sheet.

8. The fuser according to claim 7 wherein the endless belt has a predetermined stop position in which the fusing roller engages the pressure roller through the opening.

9. An apparatus for selectively providing different types of finishes to toner images carried on image sides of receiving sheets, said fuser comprising:

a pressure member;

a roller positionable to form a first nip with the pressure member to provide a first type of finish to a fused toner image on a receiving sheet;

a fusing belt positionable to form a second nip with the pressure member, said second nip providing a different type of finish to a fused toner image on a receiving sheet than that provided by the first nip;

a controller selectively applying one of said first said second nips to a receiving sheet to determine a type of finish to a toner image on the receiving sheet;

means for heating a receiving sheet in each of the first and second nips;

means for separating a receiving sheet from the belt after a toner image has cooled in contact with the belt; and wherein the means for heating is a means for heating the roller which, in turn, heats both the first and second nips.

10. The apparatus according to claim 9 wherein said belt is entrained about at least two support members for movement through an endless path, at least one of the support members being coaxial with said roller and wherein said belt has an opening through which the roller is accessible to the pressure member when said belt is at a predetermined position in its endless path.

11. The apparatus according to claim 10 wherein said roller is a fuser roller and the pressure member is a pressure roller.

12. The fuser according to claim 11 wherein the fusing roller is drivable independently of the fusing belt through an endless path with the fusing roller backing the endless belt during a portion of the endless path during which the second fusing nip is being applied to a receiving sheet.

13. An apparatus for selectively providing different types of finishes to toner images canned on image, sides of receiving sheets, said apparatus comprising:

a pressure roller;

a fusing roller positionable to form a first fusing nip with the pressure roller;

a fusing belt positionable to form a second fusing nip with the pressure roller, said second fusing nip providing a different type of finish to a fused toner image than the first fusing nip;

means for selectively applying one of said first and second fusing nips to a receiving sheet to selectively finish the toner image; and a fuser roller skive which is movable from a position engaging the fusing roller when the first nip is being applied to a toner image to a second position separated from the fusing roller when the second nip is being applied to a toner image.

14. The apparatus according to claim 13 wherein said belt is entrained about at least two support members for movement through an endless path, at least one of the support members being coaxial with said fusing roller and wherein said belt has an opening through which the fusing roller is accessible to the pressure member when said belt is at a predetermined position in its endless path.

15. A method for selectively providing different types of finishes to toner images carried on image sides of receiving sheets, said method comprising:

moving receiving sheets having toner images between a pressure member and a fusing roller positioned to form a first fusing nip with the pressure member to form a first type of finish to the toner images;

moving other receiving sheets having toner images between the pressure member and a fusing belt positioned to form a second fusing nip with the pressure roller, said second fusing nip providing a different type of finish to a fused toner image than the first type; said belt moving through an endless path and said belt having an opening through which the fusing roller is accessible to the pressure member to form the first fusing nip when said belt is moved to a predetermined position in its endless path; and selectively applying one of said first and second fusing nips to a receiving sheet to selectively finish the toner image.

16. The method of claim 15 and wherein at least one receiver sheet includes a color toner image.

* * * * *